US005431100A

United States Patent [19]

Snyder

[11] Patent Number: 5,431,100

[45] Date of Patent: Jul. 11, 1995

[54] ELECTRIC EXPLOSIVE TUBE INITIATION SYSTEM

[76] Inventor: Richard N. Snyder, P.O. Box 220, Garrisonville, Va. 22463

[21] Appl. No.: 223,977

[22] Filed: Apr. 6, 1994

[51] Int. Cl.[6] ..... F42C 11/00

[52] U.S. Cl. ..... 102/202.6; 102/200; 102/275.2

[58] Field of Search ..... 102/202.2, 217, 218, 102/275.2, 275.4, 275.8, 202.6, 200; 361/248

[56] References Cited

U.S. PATENT DOCUMENTS 4,391,195 7/1983 Shann ..... 102/201
4,969,525 11/1990 George et al. ..... 102/319
5,001,981 3/1991 Shaw ..... 102/275.8

*Primary Examiner*—Daniel T. Pihulic

*Attorney, Agent, or Firm*—Lane, Aitken & McCann

[57] ABSTRACT

In a system for connecting blasting caps to the initiation source, a redundant design structure provides a more reliable method of explosive initiation. This is accomplished by using a complete system from blasting control through the initiation line and connecting blocks to the blasting caps. The connecting structure between the initiation device and the blasting caps comprises explosive tubing so that both the explosive charge and the electric wires in the tube casing will initiate explosion of the blasting caps and destroy the initiation tube and wires.

The connecting blocks contain additional features, such as; explosive delay times, lightning and radio frequency energy attenuation circuits.

5 Claims, 2 Drawing Sheets

ELECTRIC EXPLOSIVE TUBE INITIATION SYSTEM

BACKGROUND OF THE INVENTION

Development of many initiation sources for pyrotechnic and high explosives has existed since the invention of explosives themselves.

The idea is to place the user as far away as necessary from the flash of explosives and the dangers inherent to the nature of volatile elements thereof.

Each type of initiation interface connection has an individual preference desirable to the application involved, such as cost, ease of connection, safety of the particular material and other governing factors, such as water, high power lines, dust clouds after initiation, ground vibration and air blast.

Elements after use also pose problems such as, clearing the area of residual litter, thus preventing damage to machinery and which pose safety hazards.

In the past decades, manufacturers have developed various types of initiation devices, each type to serve the purpose of their particular products.

To understand most known sources of initiation, it is necessary to carefully review the methods now available, Manufacturers can and should make changes relevant to today's technology. As a group, there is reluctance to make improvements in the forms relevant, and changes must focus on a single type of initiation system, or at least fewer than those now available, principally to enhance safety and out manufacturing costs. It is time to establish a new standard for industrial and military users of explosive initiation systems.

Table 1 displays the various types of initiation materials, their advantages and disadvantages.

TABLE 1

| CAUSES | DETONATION CORD | SHOCK TUBE | GAS TUBE | ELECTRIC WIRE | EXPLODING BRIDGE WIRE |
|---|---|---|---|---|---|
| AIR BLAST NOISE | X | | | | |
| INABILITY TO TEST BEFORE FIRING | X | X | | | |
| DUST CLOUD | X | | | | |
| LITTER | | X | X | X | |
| WATER | | X | X | | |
| ABRASION | | X | X | X | X |
| BREAKAGE | | X | X | X | X |
| SAFETY HAZARDS | X | X | X | X | X |
| CONNECTING DIFFICULTY | | | X | X | X |
| RADIO FREQUENCY PREMATURE FIRING | | | | X | |

SUMMARY OF THE INVENTION

This invention intends to combine the number of initiation types to obtain the best features known.

The electric hard wire blasting cap principal uses two wires that connect a blasting machine to an electrical blasting cap or squib, is of known reliability.

Equally reliable is the shock tube and detonating cord.

Each system contains certain undesirable effects which can be overcome by using state of the art technology.

To perform manufacturing at a safe and reliable level, the explosive energy need be of sufficient level to explode the wire, line and blasting cap. This would disperse litter to small fragment size, harmless to the environment.

The system will cut cost and improve safety. The byproduct being, destruction of wire and residual explosive tubing that must otherwise be gathered for disposal to prevent damage from entering the rock crushers and other mining equipment involved in the processing of ore bodies, etc.

Using the electric wire system and combining it with a detonating cord, tube or shock tube, will permit improvement over the existing initiation sources, for example, detonating cord containing electric wires would do the following: allow testing, prevent litter, be resistant to water, abrasion and breakage. Certain types of detonation cord could reduce or almost eliminate dust cloud and air blast noise. Also available would be low temperature initiation line able to withstand temperatures below 40 degrees Fahrenheit.

DRAWINGS

FIG. 1: OVERALL SYSTEM
(1) blasting device with built in ohmmeter
(2) connecting block
(3) initiation line
(4) blasting circuits FIG. 2: ELECTRIC EXPLOSIVE INITIATION TUBE
(11) casing
(13) explosive charge
(6) electric wires FIG. 3: ELECTRIC EXPLOSIVE CONNECTING BLOCK
tube connecting block
female socket
circuitry
electric explosive tube FIG. 4: ELECTRIC EXPLOSIVE CONNECTING BLOCK SCHEMATIC
electrical connections
explosive block
time delay, lightning and radio frequency protection network FIG. 5: ELECTRIC EXPLOSIVE BLASTING CAP
casing
electric initiation source
explosive initiation source
explosive charge
seal

DESCRIPTION OF A PREFERRED EMBODIMENT OF THE INVENTION

Figure 1:
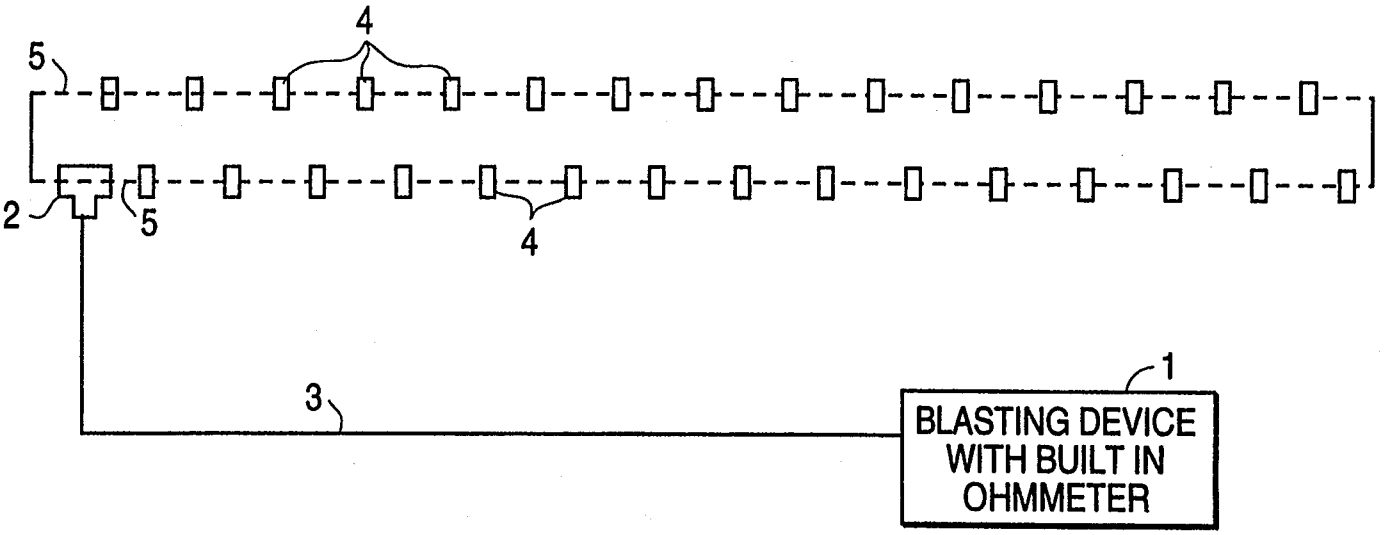
Figure 2:
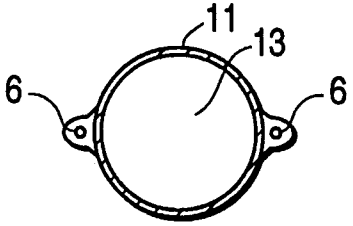
Figure 3:
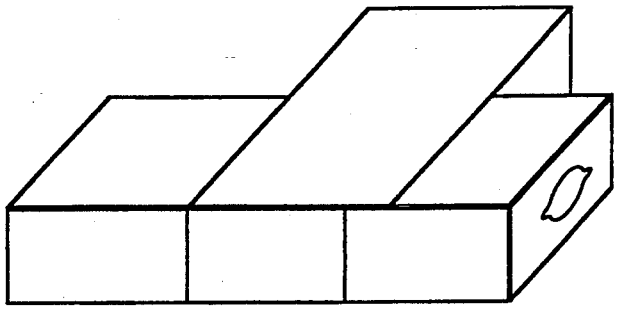

A typical blasting layout (as seen in FIG. 1), uses the electric explosive tube blasting cap (FIG. 5), electric explosive tube (FIG. 2) and the connecting blocks (FIG. 3).

A blasting control unit 1, see FIG. 1, will detonate the blast by means of an interface connector 2, connected to the electric explosive initiation tube 8, and lines of electric tube blasting caps 4. The blasting machine design provides an electrical impulse as well as a pyrotechnic flash. The lines of blasting caps are connected to the interface connecting block by electric explosive tube 5, similar to the initiation tube 3.

When completed, continuity of explosive detonation line, FIG. 2, will follow a preset pattern. Two wires 6, accompany the same path, testing for continuity.

As shown in FIG. 2, the initiation line S comprises a tubular casing 11 filled with explosive charge 18 and two electrical wires 6, mounted on the casing to extend axially along the tubular casing.

Multiple input-output connecting blocks, FIG. 8, are a strong link in the chain of this electric explosive tube initiation system. These blocks connect the blasting caps to the initiation tubing 5. These blocks are structurally the same as the interface connector. As shown in FIG. 3, initiation line interface connectors or connecting blocks, consist of a preformed, palm of hand size casing containing explosive that will enable the technician to easily connect all blasting caps together in a configuration to simplify the blast layout procedure and reduce time involved in doing so.

Figure 5:
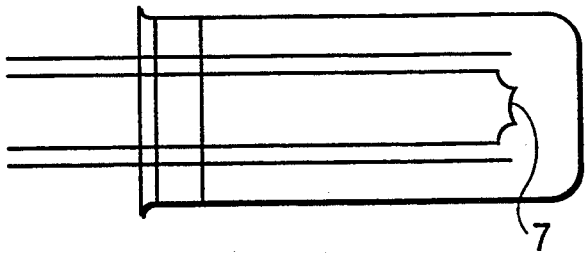

The two combined sources of initiation, FIG. 5, as earlier explained, will increase initiation and provide the technician with the ability to test the electrical circuit before initiation. Positive tests of the electric circuit also tests the explosive initiation tube.

Figure 4:
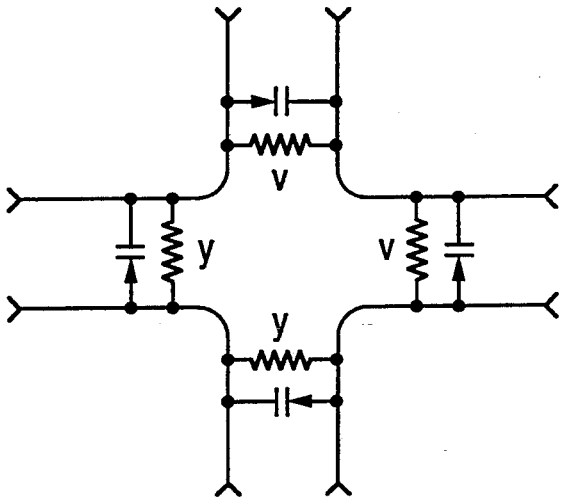

Having multiple connecting ports enables infinite connecting possibilities. The connecting blocks perform the following functions: 1. electrically connect sections of the initiation line; 2. explosively connecting the explosive tube section; 3. performing a short circuit to radio frequency or lightning strikes by a resistive/-capacitive attenuation network; 4. contain an electronic or explosive delay necessary for technical aid in obtaining precision blasting initiation times. Simplicity of design and manufacturing will save time in performing a neat and clean work area, void of cumbersome connecting wires or thousands of feet of tubing to contend with. The radio frequency/lightning safety circuit, an integral part of the connecting block, protects as was a similar telephone lightning protection circuit found in the international telephone systems. FIG. 4 is a typical example. Though the structure may be somewhat complex, the main embodiment design easily interfaces with most initiation systems found in mining, military or demolition configurations.

METHOD OF OPERATING THE SYSTEM

The task of operating this invention consists of carrying the three (3) components together to the blast site, the blast holes having been dug.

The electric explosive tube blasting cap is loaded in each hole (according to MSHA regulations) and explosive tubing is connected to each cap as shown in FIG. 5.

The electric explosive tube, having been extended away from the blast holes, is then connected to the connecting block(s) by the method described in FIG. 3.

Additional electric explosive tubing may then be connected to the block for additional standoff distance.

The electric explosive tubing connects to the blasting device and should then be checked with the ohmmeter for continuity.

The operator then sounds the danger signal, and initiates the blast by activating the wiring switch and completing the blast sequence.

OPERATION (1) The operator observes the continuity ohmmeter on the blasting control for the indication of continuity.

(2) The operator activates the firing switch, completing the firing sequence.

When the firing switch is activated, the control unit 1 ignites the explosive in the initiation tube 3. The explosive initiation tracks along the initiation tube 3 through the interface connector 2, through the initiation tube 5 and through connecting blocks to the blasting caps 4 to ignite the blasting caps. At the same time, an electrical impulse will travel through the wires 6 along the initiation tube 3, then through the electrical circuit of the interface connector 2, through the electrical wires of the initiation tube 5, through the circuitry of the connecting blocks to the ignition wire 7 in the blasting caps to provide redundant ignition of the blasting caps.

Having described the invention, reference has been made to a preferred embodiment of the invention, using illustrative advantages of the invention.

I claim:

1. A blasting system comprising at least one electrical blasting cap capable of being ignited by an electrical ignition signal applied to said blasting cap and by explosive initiation applied to said blasting cap through an explosive charge, a blasting control, and a connection between said blasting control and said blasting cap, said blasting control comprising means to ignite said blasting cap through said connection, said connection being operable to ignite said blasting cap by transmitting an electrical ignition signal from said blasting control toward said blasting cap and by simultaneously carrying explosive initiation from said blasting control toward said blasting cap for applying explosive initiation to said blasting cap to thereby provide redundant ignition of said blasting cap.

2. A blasting system as recited in claim 1, wherein at least a portion of said connection comprises an initiation tube comprising a tubular casing filled with an explosive charge and a pair of electrical wires extending axially along said tubular casing, said blasting control being operable to apply explosive initiation to said blasting cap by igniting the explosive charge in said tubular casing so that explosive ignition travels through the explosive charge of said tube to said blasting cap and to apply an electrical ignition signal to said blasting cap through said pair of wires.

3. A blasting system as recited in claim 1, wherein said blasting system includes a plurality of blasting caps and wherein said connection carries said explosive ignition from said blasting control toward all of said blasting caps and simultaneously carries said electrical ignition signal to all of said blasting caps to provide redundant ignition of all of said blasting caps.

4. A blasting system as recited in claim 2, wherein said blasting control includes means to test the continuity of the electrical connection from said blasting control to said blasting caps through said pair of wires.

5. A blasting system as recited in claim 1, wherein said connection includes an electrical interface block connecting said initiation tube to a plurality of additional initiation tubes connecting with said blasting caps, said connecting blocks providing electrical connection between the electrical wires of said first mentioned initiation tube and electrical wires in said additional initiation tubes and providing for transmission of explosive initiation from said first mentioned initiation tube to said additional initiation tubes.

* * * * *